US005269099A

United States Patent [19]

Kennedy et al.

[11] Patent Number: 5,269,099

[45] Date of Patent: Dec. 14, 1993

[54] REFRIGERATOR CABINET WITH COMBINATION SEALING ARRANGEMENT INCLUDING BREAKER PANELS

[75] Inventors: Adam C. Kennedy; Martin M. Zentner, both of Louisville, Ky.

[73] Assignee: General Electric Company, Louisville, Ky.

[21] Appl. No.: 932,800

[22] Filed: Aug. 20, 1992

[51] Int. Cl.[5] ..... E06B 7/16

[52] U.S. Cl. ..... 49/484.1; 49/475.1; 49/478.1; 49/492.1

[58] Field of Search ..... 49/475.1, 478.1, 484.1, 49/485, 488, 487, 492.1, 495.1, 498.1, 366; 312/236; 62/275

[56] References Cited

U.S. PATENT DOCUMENTS

| | | | |
|---|---|---|---|
| 1,789,066 | 1/1931 | Chadwick et al. | 49/485 |
| 1,798,720 | 3/1931 | Burns | 49/495 |
| 2,449,384 | 9/1948 | Hursey et al. | 49/366 |
| 2,734,238 | 2/1956 | Clapp | 49/495 |
| 3,378,956 | 4/1968 | Parks et al. | 49/485 |
| 3,378,958 | 4/1968 | Parks et al. | 49/495 |
| 4,134,627 | 1/1979 | Kuskowski | 312/236 X |
| 4,142,766 | 3/1979 | Swerbinsky | 312/236 X |
| 4,653,819 | 3/1987 | Swerbinsky | 49/487 X |
| 5,117,587 | 6/1992 | Doan | 49/475 X |

FOREIGN PATENT DOCUMENTS

| | | | |
|---|---|---|---|
| 631093 | 11/1961 | Canada | 49/478 |
| 495238 | 6/1954 | Italy | 49/484 |

*Primary Examiner*—Peter M. Cuomo
*Assistant Examiner*—Michael J. Milano
*Attorney, Agent, or Firm*—Radford M. Reams; H. Neil Houser

[57] ABSTRACT

A refrigerator cabinet includes a storage compartment defined by encased walls including inner metal panels and corresponding breaker panels forming a peripheral edge surface surrounding the access opening. A door is hingedly mounted adjacent one edge and includes a resilient sealing gasket to seal the opening. A resilient flap is formed on the breaker panel so that an auxiliary seal is formed separate from the gasket against the liner panel of the door upon closing. An extended dead air space is provided between the flap, gasket and the opposed panels so that heat transfer from the area of the gasket into the compartment is substantially eliminated. The elongated body of the flap is approximately 70 Shore A Durometer hardness of a suitable plastic, such as polyvinylchloride. In the preferred embodiment, the cross-section of the body takes the form of a spike in cross-section with a convergent 5° angle from the base. The flaps extend at included angles of approximately 45° to the panels.

14 Claims, 2 Drawing Sheets

REFRIGERATOR CABINET WITH COMBINATION SEALING ARRANGEMENT INCLUDING BREAKER PANELS

TECHNICAL FIELD

The present invention relates to refrigerator/freezer cabinet structure and, more particularly, to a cabinet with interior metal panels and plastic breaker panels, providing an improved sealing arrangement for reducing the energy loss around the gasket of the door.

A related case is U.S. patent application Ser. No. 07/932,801, filed Aug. 20, 1992, entitled "Refrigerator Cabinet with Combination Sealing Arrangement", assigned to the present assignee.

BACKGROUND OF THE INVENTION

It is well known that the requirements for improved cabinet insulation and sealing the door/cabinet interface in refrigeration appliances are becoming more and more stringent. In order to comply with the United States Department of Energy standards to reduce energy consumption in the coming few years, substantial improvements must be made. However, in order to keep the cost of manufacture of refrigerators and freezers as low as possible, it is, of course, desirable to maintain as much of the prior cabinet design as possible as the improvements are made. With this as a given factor, the most likely source for energy saving improvements and revisions involves the elimination of heat leakage around the door gasket into the storage compartment.

There have been numerous attempts to do this by improvement to the gasket construction itself, such as shown in the Swerbinsky U.S. Pat. No. 4,653,819, issued Mar. 31, 1987, and assigned to the assignee of the present invention. The approach in this prior art reference is primarily to direct the face of the magnetic gasket in a direction as it approaches the peripheral edge surface of the encased walls of the cabinet so that the gasket is not distorted during closing of the door. Other arrangements providing improvements in the structure of the gasket itself, as well as the mounting arrangement on the periphery of the door, defines a main focal point of thinking among refrigeration appliance engineers.

In the prior art patent '819, there is an incidental suggestion that air insulating spaces positioned between the peripheral edge surface of the encased walls and the corresponding face of the door play a role in stopping heat leakage. It has been found, however, that these relatively small captive spaces provide very limited additional improvement in the abatement of the heat leakage problem. First, the spaces are formed by parts of the gasket itself so that there still remains a direct conducting heat flow path through the gasket structure itself from outside the compartment to the inside. It has been found that this direct heat conduction path provides significant heat leakage, and is not prevented by the insulating spaces suggested in the patent. Furthermore, the spaces are all defined by movable parts of the sealing gasket and depend on contact that is governed by the seating of the magnetic seal. In other words, the spaces are formed only as a secondary consideration and any variation in the magnetic seal engagement, such as due to wear, can actually cause the spaces to open up and thereby eliminate any advantage whatsoever.

Another main path of heat conduction is by means of the projection of the case flange into the refrigerated compartment where the flange is subjected to compartment air flow.

By this invention, there is provided a refrigerator cabinet which includes a gasket and a separate auxiliary flap on the breaker panel or strip of an outside wall or of a mullion; the flap on the breaker panel extending into sealing engagement with the liner panel of the door to significantly cut down on heat leakage, and thereby substantially increase the sealing efficiency.

SUMMARY OF THE INVENTION

A refrigerator cabinet includes a storage compartment having an access opening surrounded by a peripheral edge surface against which the resilient sealing gasket on the door engages for sealing. The walls of one particular style cabinet includes metal inner panels and cooperating plastic breaker panels or strips extending inwardly from the peripheral edge surface. A corresponding plastic liner panel on the door extends inwardly within the compartment a sufficient distance around the periphery so that when the door is closed, an opposed panel relationship is provided. The plastic panels "break" the heat conductivity path and, together with the opposed panel relationship, a partial dike against heat transfer from the area of the gasket into the storage compartment is formed.

According to the present invention, a resilient flap is positioned on at least one of the breaker panels, for sealing engagement with the opposed liner panel of the door when the door is closed. This flap is separate from the gasket, and forms an extended dead air space in cooperation with the gasket, as well as both of the opposed panels. Ideally, a flap extends along all sides of the opening including the corners. As a result, the heat leakage paths into the storage compartment and, thus, the heat transfer from the area of the gasket is substantially eliminated. In addition, the flap structure in conjunction with the opposed panels provide a dam or break protecting the inturned flanges of the outer metal cabinet from refrigerated compartment air flow. This results in significant improvement in the sealing efficiency, and thus the overall energy saving efficiency rating for the refrigeration cabinet.

Preferably, the flap includes an elongated wiper of elastomeric material, such as can be easily formed of extruded plastic, and ideally having a hardness of approximately 70 Shore A, Durometer. A base of semi-rigid elastomeric material is provided to ensure a firm mounting so as to efficiently hold the flap in the sealing position. The base of the flap is preferably formed integrally with the plastic breaker panel itself. The wiper/flap/breaker panel are most efficiently fabricated by extrusion of the two materials for all three components simultaneously through a single die. An elastomeric material of choice is polyvinylchloride (PVC), although other plastics, such as ABS plastic, or natural or synthetic rubber, can be used.

In the preferred embodiment of the flap, the body or wiper portion has a spike-like cross-section defined by an approximately 5° converging angle from the proximal end. The flap extends at acute included angles of approximately 45° with respect to both the breaker panel and the liner panel. Mitered corner joints (not shown) overlapping flap portions at the corners, or corner inserts similar to those disclosed in the pending related application identified above, may be provided to further enhance the sealing around the full perimeter of the door/cabinet interface.

The integral breaker panel/sealing flap arrangement can be used not only with the typical side wall breaker panel, but also with dual breaker panels or strips incorporated to form the complete mullion (either a top mount, bottom mount, or side-by-side refrigerator/freezer combination). Preferably, when used for the mullion, flaps are formed integrally and simultaneously in a single die on each side of an integrated U-shaped breaker panel.

BRIEF DESCRIPTION OF THE DRAWINGS

The accompanying drawings incorporated in and forming a part of the specification, illustrate several aspects of the present invention and together with the description serve to explain the principles of the invention. In the drawings.

Reference will now be made in detail to the present preferred embodiment of the invention, an example of which is illustrated in the accompanying drawings.

DESCRIPTION OF THE PREFERRED EMBODIMENT

Figure 1:
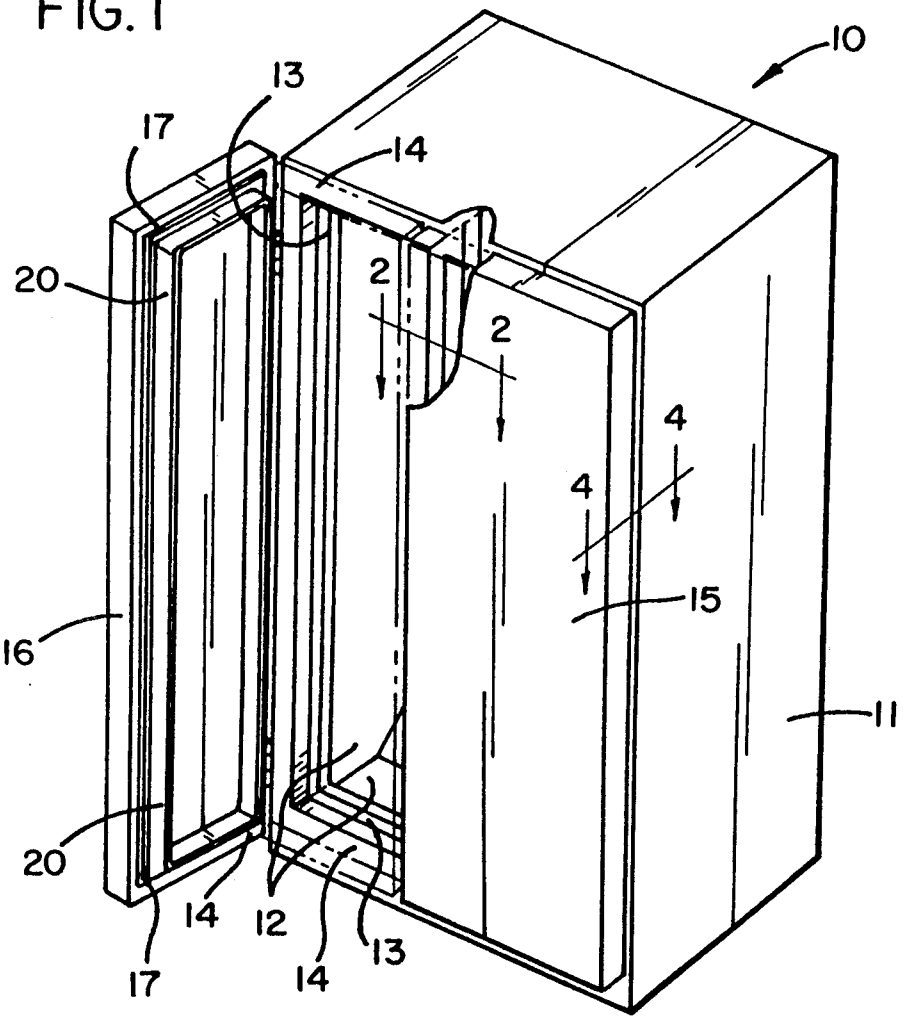
FIG. 1 is a simplified perspective view of a complete insulated refrigeration appliance, including side-by-side freezer and refrigerator storage compartments, showing the freezer door open, and incorporating an improved sealing arrangement of the present invention.

Referring to FIG. 1 of the drawings in particular, there is illustrated a refrigerator including a cabinet, generally represented by the reference numeral 10, and comprising an outer metal shell 11 defining encased walls including metal inner panels 12, and cooperating breaker panels 13 defining a freezer storage compartment. It is understood that the refrigerator storage compartment beside the freezer has a sealing arrangement (not shown in this figure) which is the same as that for the freezer compartment; and this fact will be evident from reviewing the additional description below.

The encased walls form a peripheral edge surface 14 extending around and defining the corresponding access openings for the compartments. A refrigerator door 15 and a freezer door 16 are hingedly mounted on the cabinet 10 adjacent opposite vertical edges to close the respective storage compartments. A conventional magnetic, resilient sealing gasket 17 is mounted around the inside edge of each of the doors 15, 16. As is well known, the sealing gaskets are attracted to the magnetic (metal) plate typically placed along the peripheral edge surface 14. Since the sealing arrangement for both the refrigerator door 15 and the freezer door 16 is the same with respect to the present invention, the description that follows refers to the structure relating to each of the doors, from time to time for ease of description and understanding. Also, it is to be understood that the arrangement applies not only to a side-by-side door arrangement illustrated in FIG. 1, but is likewise applicable to the common "top mount" arrangement in which the freezer compartment is mounted above the refrigerator compartment.

Figure 2:
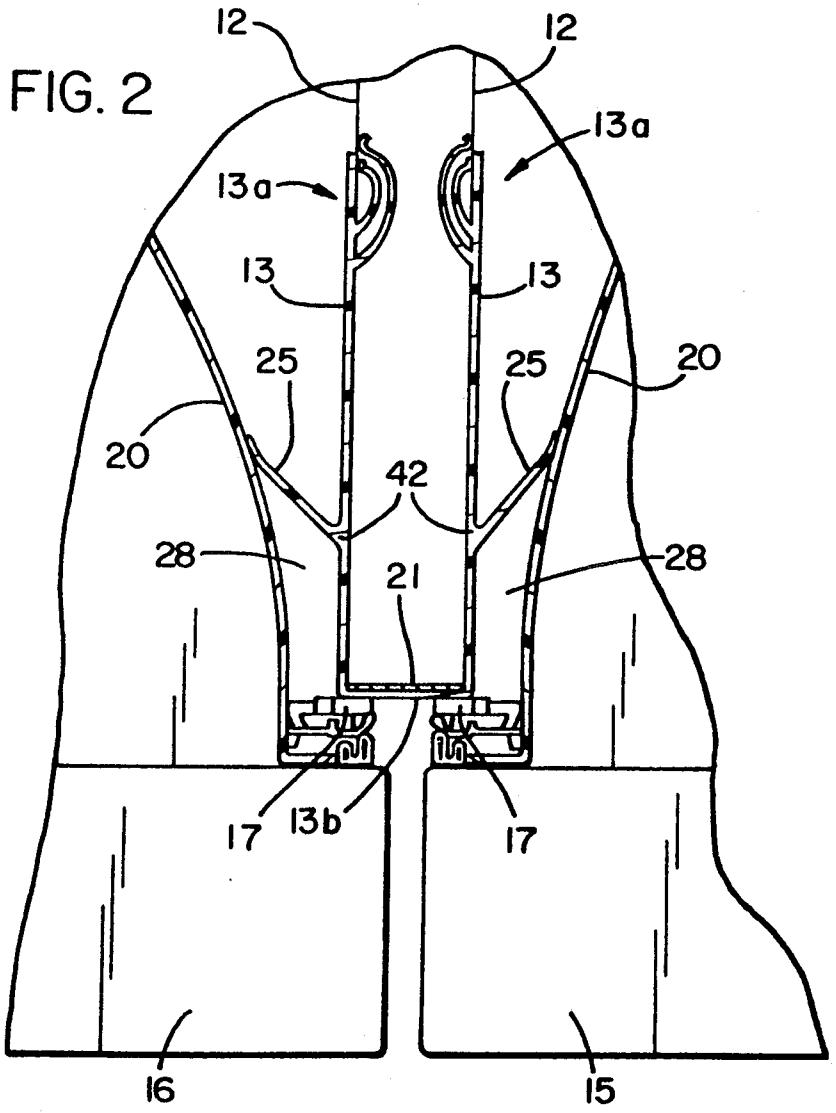
FIG. 2 is an enlarged cut-away cross-sectional view, generally as seen along line 2—2 in FIG. 1, showing the freezer door an the adjacent refrigerator door closed in sealing engagement with the mullion, and with the auxiliary sealing flaps on the breaker panel engaging the inner liner panels of the doors.
Figure 4:
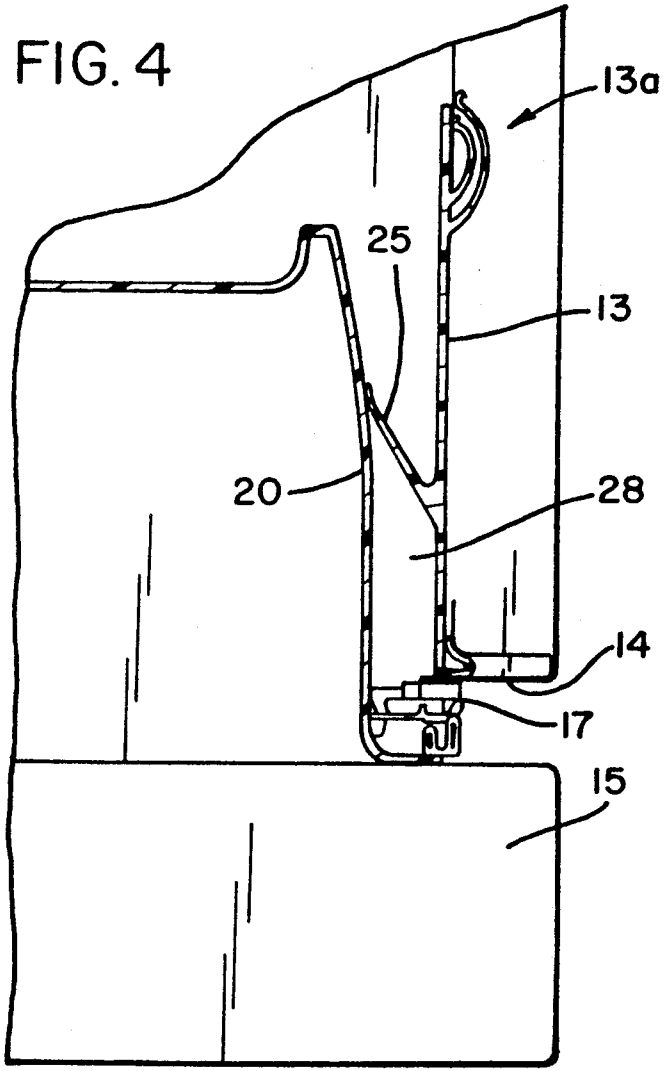
FIG. 4 is an enlarged cross-sectional view, as seen along line 4—4 in FIG. 1, of the refrigerator door with the gasket sealed on the peripheral edge surface of an encased outside wall, with a sealing flap of the present invention engaging the liner panel of the door.

As illustrated in FIG. 4, around the outer periphery of the compartments the plastic breaker panels 13 extend inwardly from the peripheral edge surface 14 and connect to the metal panels 12 by a suitable chyliform clamp/seal 13*a*. This clamp/seal arrangement is described in more detail, along with the panels themselves, in U.S. Pat. No. 4,134,627, issued Jan. 16, 1979, and assigned to a sister company of the present assignee (incorporated herein by reference). As illustrated in FIG. 2, a pair of spaced apart breaker panels 13 are joined by a transverse base on bight 13*b* to form an integral U-shaped breaker panel assembly. Each panel 13 includes a chyliform clamp/seal 13*a* which connects to the metal panels 12 forming the mullion between the freezer and fresh food compartments. A preferred plastic for the breaker panels 13 is polyvinylchloride (PVC), although other plastics, such as ABS plastic, or even other materials with similar insulating qualities, may be utilized. Likewise, a vacuum formed plastic liner panel 20 is provided on each of the doors 15, 16 and extends inwardly within the corresponding storage compartment when the door is closed.

The liner panels provide additional shelf space within the compartments, as is typical (not shown). Of importance to the present invention is that the liner panel 20 extends inwardly a sufficient distance around the periphery of the access opening so that when the doors 15, 16 are closed, a semi-enclosed space or partial dike against heat transfer is formed. As will be seen below, the concept of the present invention builds on this semi-enclosed space between the liner panel 20 and the breaker panel 13 which, in the preferred embodiment, is along all four sides of the access opening; i.e. an improvement in restricting heat transfer from the area of the gasket 17 into the compartment is achieved by the present invention. To put it another way, the restricted area between the opposed panels 13, 20 tends to prevent the cold air within the refrigerator compartment from freely migrating outwardly toward the area around the gasket 17; and it is within this restricted area that the improvement of the present invention is focused.

With specific reference to FIG. 2, when the doors 15, 16 are closed the magnetic gaskets 17 are attracted to a metal (magnetic) plate 21 fixed behind the bight 13*b* of an integral U-shaped breaker panel assembly that includes the dual panels 13. A resilient, elongated flap 25 is provided on each of the dual panels 13 for the purpose of sealingly engaging the opposed liner panels 20 during closing of the door 15. As illustrated, the flap 25 is directed rearwardly so that included angles of approximately 45° are defined with respect to both of the panels 13, 20.

With specific reference to FIG. 4, when the door closes the top, bottom and outer side portions of the magnetic gaskets 17 are attracted to the peripheral edge surface 14 of the metal shell 11. The elongated flap 25 provided on the single panels 13 engage the liner panels 20 in the manner described above for the flaps 25 of the dual breaker panels 13 in FIG. 2. In this way, flaps 25 engage the liner panels 20 around the entire periphery of the freezer and the refrigerator compartments.

As illustrated, the flap 25 is spaced inwardly from the edge of the liner panel 20 and is separate from the gasket 17. As a result, there is advantageously formed an extended dead air space 28 defined by the gasket 17, both of the opposed panels 13, 20, an the flap 25 as best shown in FIG. 2.

Thus, it can be seen that the combination of the gasket 17 and the flap 25, in accordance with the present invention, inhibits heat transfer from the area of the gasket into the storage compartment. In addition, engagement of the flaps 25 with the liner panels 20 substantially prevents the refrigerated air within the refrigeration compartment from impinging upon the peripheral edge surface 14 inside the gasket 17. To put it another way, the extended isolated air space 28, in combination with the basic, state-of-the-art gasket 17, eliminates significant heat leakage into the storage compartment. Conversely, the cold air within the compartment is not allowed to move into contact with the gasket 17 and with the edge surface 14, and thus the energy loss that is experienced in a cabinet having only a standard peripheral gasket 17 is overcome.

To make the combination sealing arrangement complete, the dead air space is preferably in the form of a surrounding, annular space by employing one of the breaker panels with the elongated flaps 25 along each side of the storage compartment (see FIGS. 1 and 2). This arrangement then forms a full perimeter auxiliary seal, and assures the formation of the corresponding full perimeter, annular dead air space 28. A corner sealing arrangement with overlapping corners, mitered edges or corner inserts (not shown), may be provided to interconnect the adjacent ends of the flaps 25.

Figure 3:
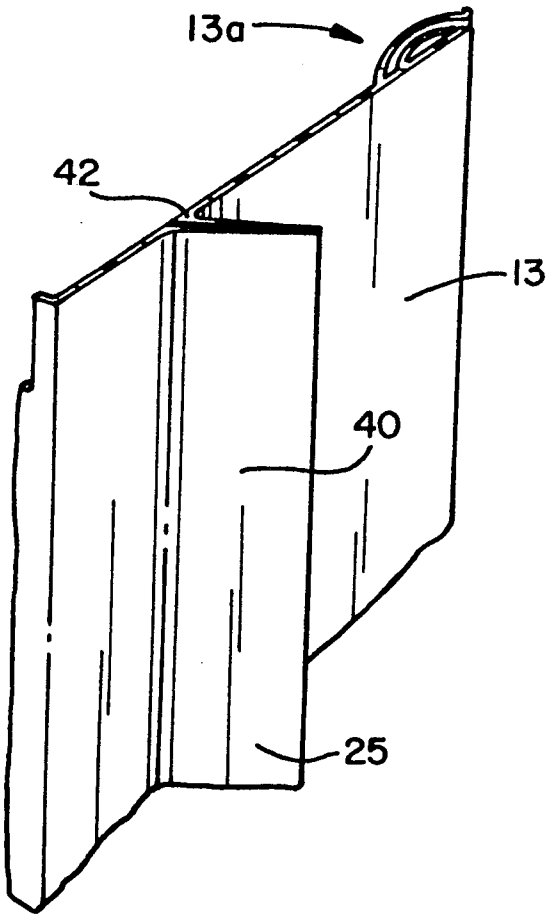
FIG. 3 is an enlarged, partially broken away, perspective view of the preferred embodiment of the breaker panel with the integrally formed, auxiliary sealing flap.

As illustrated in FIG. 3, the flap 25 itself takes the form of an elongated wiper with a body 40, and is preferably extruded of elastomeric material, such as relatively soft PVC plastic, ABS plastic or natural or synthetic rubber. The preferred PVC plastic, selected from tests conducted in the laboratory, is PVC with a rating of 70 (plus or minus 3), Shore A, Durometer hardness. The body 40 is integrally formed with the breaker panel 13. The base 42 of body 40 (see FIG. 3) and the breaker panel 13 preferably are formed of semi-rigid plastic material such as PVC or ABS for example. The base 42 assures stability of the spike-like (cross-section) body 40 as it wipes against the opposed panel 20 during closing (see FIG. 2), as well as providing stability during the performance of the sealing function once the door 16 is fully closed.

The resilient, spike-like body 40 supported by the base 42 incorporates sufficient elastic memory in order to return it to its unflexed or uncompressed state (see FIG. 3) each time the door 16 is opened. This assures that the full sealing engagement illustrated in FIG. 2 is accomplished each time the door is closed. Preferably, the length or operative thickness of the flap 25 relative to the space 28 between the opposed breaker/liner panels 13, 20, and the wiping relationship of the flap 25 against the liner panel 20, is such that a full auxiliary seal occurs as the door 15, 16 is closed;

Providing the flap 25 spaced from and separate from the gasket 17 means that two other advantages are obtained; (1) the annular air space 28 is extended so that any heat leakage past the gasket 17 has a longer path to travel before approaching the sealed compartment; and (2) there is no direct heat conduction through the structure of the gasket 17 to the flap 25.

Preferably, the breaker panels 13 and the flaps 25 are extruded all in one operation. This is done by injecting the relatively soft PVC plastic into the die to form the body 40 while similar semi-rigid plastic is injected to form the base 42 and the panel 13 itself.

The flap 25 operates with the distal edge or tip engaging the opposed panel 20, as can be visualized by viewing FIG. 3, the tapered tip wipes along and seals against the surface of the panel 20, flexing progressively as the closing of the door 16 proceeds. The annular space provided by the combination of the flap 25, the gasket 17 and the panels 13, 20 thus maximizes the isolation of any heat that might leak past the gasket 17 and substantially prevents refrigerated air from impinging on the peripheral edge surface 14. Thus, the combination sealing arrangement of the present invention provides the maximum energy saving coefficient for the refrigerator/freezer cabinet 10, that is otherwise a standard design.

While one elongated-flap 25 is shown on each panel 13, two or more flaps 25 could be used together in tandem to increase the sealing efficiency.

In summary, it will be realized that the insulated refrigeration appliance of the present invention provides substantial results and advantages over the prior art. The combination sealing arrangement of the resilient, elongated flap 25 integrally formed on the breaker panel 13 and pressed against the liner panel 20, along with the resilient sealing gasket 17, forms the dead air space 28. Of importance is that there is no direct interconnection between the flap 25 and the gasket 17. This has the effect of inhibiting the transfer of heat to the storage compartment of the cabinet 10. Especially because this dead air space 28 is of extended length and annular in shape, it enhances the energy saving coefficient of the cabinet 10 to a degree necessary to not only meet the stringent design requirements of today, but the requirements expected for years to come. The key advantageous result is simply that more heat is kept out of the sealed compartment and, conversely, more cold kept in. Solid wiping contact between the flaps 25 and the inner panel 20 provides the maximum seal and energy savings. However, such contact increases the force needed to close and open the door. Alternately, in some applications it may be desirable to limit the contact force or interference between the flaps 25 and liner panel 20. At the extreme, a very slight gap might be maintained between these elements. While such a slight gap would still provide an air flow seal significantly impeding air flow and heat transfer, it would sacrifice some energy savings in favor of ease and certainty of full door closure.

While, in accordance with the patent statute, there is described herein what at present is considered to be the preferred and alternative embodiments of the sealing arrangement of the invention, it will be obvious to those skilled in the art that various changes and modifications may be made without departing from the invention. It is, therefore, intended by the appended claims to cover all such changes, modifications and equivalent structure, as fall within the true spirit and scope of the invention.

We claim:

1. An insulated refrigeration appliance including a cabinet comprising:

a storage compartment in said cabinet having encased walls forming a peripheral edge surface surrounding an access opening;

said walls including corresponding inner edge surfaces and breaker panels extending inwardly from said edge surface;

a door hingedly mounted on said cabinet adjacent one edge to close said opening;

a resilient sealing gasket on said door between said door and said peripheral edge surface to seal said opening;

a liner panel on said door extending inwardly within said compartment a sufficient distance around the periphery of said opening when the door is closed to form with the opposed breaker panel a partial dike against heat transfer from the area of the gasket into said compartment; and a resilient, elongated flap on said breaker panel for forming an air flow seal with the opposed liner panel during closing, said flap being separate from the gasket for forming an extended dead air space in cooperation with said gasket and both of said opposed panels;

whereby heat transfer from the area of said gasket into said compartment is substantially eliminated.

2. The refrigeration appliance of claim 1, wherein said flap includes an elongated wiper of elastomeric material.

3. The refrigeration appliance of claim 2, wherein said elastomeric material of said flap is ABS plastic.

4. The refrigeration appliance of claim 2, wherein said elastomeric material of said flap is polyvinylchloride.

5. The refrigeration appliance of claim 2 wherein said flap includes an integral base of semi-rigid elastomeric material.

6. The refrigeration appliance of claim 5, wherein said semi-rigid elastomeric material of said base is ABS plastic.

7. The refrigeration appliance of claim 5, wherein said semi-rigid elastomeric material of said base is polyvinylchloride.

8. The refrigeration appliance of claim 1, wherein said elongated flap is integral with said breaker panel.

9. The refrigeration appliance of claim 8, wherein said elongated flap includes a body having a convergent, approximately 5° angle from its proximal end defined by an integral base.

10. The refrigeration appliance of claim 1, wherein said flap includes a base integral with said breaker panel, said flap being formed as an elastomeric wiper and including a relatively soft body to engage the opposed liner panel for sealing and a semi-rigid base for firm mounting.

11. The refrigeration appliance of claim 2, wherein said flap is integrally molded to have a relatively soft body and a semi-rigid base.

12. The refrigeration appliance of claim 1, wherein one of said resilient, elongated flaps is positioned between each pair of opposed breaker and liner panels to provide a substantially closed annular air space for improved sealing around substantially the full periphery of the access opening.

13. The refrigeration appliance of claim 1, wherein said flaps are of sufficient length to seal across the space between opposed breaker and liner panels before full sealing of the gasket to assist in forcing ambient air from said compartment during closing.

14. The refrigeration appliance of claim 1, wherein said flap extends at included angles to the breaker and liner panels of approximately 45°.

* * * * *